US011473242B2

(12) United States Patent
Hajnal

(10) Patent No.: US 11,473,242 B2
(45) Date of Patent: Oct. 18, 2022

(54) TREATED PULP AND METHODS OF MAKING AND USING SAME

(71) Applicant: International Paper Company, Memphis, TN (US)

(72) Inventor: Andre Stephan Hajnal, Anderson Island, WA (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 16/372,317

(22) Filed: Apr. 1, 2019

(65) Prior Publication Data

US 2020/0308766 A1 Oct. 1, 2020

(51) Int. Cl.

| | |
|---|---|
| ***D21C 9/00*** | (2006.01) |
| ***D21H 21/06*** | (2006.01) |
| ***D21H 17/06*** | (2006.01) |
| ***D21C 9/18*** | (2006.01) |

(52) U.S. Cl.

CPC ..... *D21C 9/002* (2013.01); *D21C 9/18* (2013.01); *D21H 17/06* (2013.01); *D21H 21/06* (2013.01)

(58) Field of Classification Search

None

See application file for complete search history.

(56) References Cited

U.S. PATENT DOCUMENTS

| | | | | |
|---|---|---|---|---|
| 4,822,453 | A * | 4/1989 | Dean et al. | D06M 13/395 162/157.6 |
| 5,137,537 | A * | 8/1992 | Herron et al. | A61L 15/28 8/120 |
| 5,366,591 | A * | 11/1994 | Jewell | A61F 13/15707 162/9 |
| 5,547,541 | A | 8/1996 | Hansen et al. | |
| 5,789,326 | A | 8/1998 | Hansen et al. | |
| 6,059,924 | A * | 5/2000 | Hoskins | D21C 9/007 162/9 |
| 6,340,411 | B1 * | 1/2002 | Hansen et al. | A61F 13/0206 162/173 |
| 6,436,231 | B1 * | 8/2002 | Graef et al. | A61F 13/15707 162/9 |
| 6,521,087 | B2 * | 2/2003 | Hansen et al. | A61F 13/0206 162/173 |
| 6,627,249 | B2 * | 9/2003 | Hansen et al. | A61F 13/0209 427/2.31 |
| 6,689,934 | B2 * | 2/2004 | Dodge, II | A61L 15/60 604/367 |

(Continued)

FOREIGN PATENT DOCUMENTS

| | | | | |
|---|---|---|---|---|
| WO | WO-9627703 | A1 * | 9/1996 | D04H 1/54 |
| WO | 2015/165588 | A1 | 11/2015 | |

*Primary Examiner* — Jose A Fortuna

(74) *Attorney, Agent, or Firm* — Thomas W. Barnes, III

(57) ABSTRACT

Treated pulp sheets comprising cellulose pulp fibers treated with a densifying agent and having a relatively low moisture content. In certain embodiments, the treated pulp sheets are used to produce fiberized pulp having low knot content, while maintaining density and softness properties usually associated with similarly treated pulp that is fiberized at higher moisture content. Methods of making fiberized pulp from the treated pulp sheets, as well as products comprising the treated pulp sheets or fiberized pulp from the treated pulp sheets, are also provided.

13 Claims, 17 Drawing Sheets

(56) References Cited

U.S. PATENT DOCUMENTS

| | | | | |
|---|---|---|---|---|
| 7,144,474 | B1 * | 12/2006 | Hansen | D21C 9/005 162/12 |
| 7,854,822 | B2 * | 12/2010 | Chmielewski | D21H 21/22 162/157.6 |
| 8,801,901 | B1 * | 8/2014 | Wiley | D21H 15/04 162/158 |
| 10,214,858 | B2 * | 2/2019 | Hamed | D21H 17/07 |
| 11,041,272 | B2 * | 6/2021 | Sealey | D04H 1/732 |
| 2002/0025435 | A1 * | 2/2002 | Hansen et al. | D21H 11/16 428/403 |
| 2003/0121623 | A1 * | 7/2003 | Westland et al. | D21H 17/07 162/9 |
| 2003/0139712 | A1 * | 7/2003 | Dodge, II et al. | A61L 15/60 604/368 |
| 2003/0139715 | A1 * | 7/2003 | Dodge, II | A61L 15/60 604/368 |
| 2004/0063367 | A1 * | 4/2004 | Dodge, II | A61L 15/60 442/411 |
| 2005/0000669 | A1 * | 1/2005 | West | A61F 13/53 162/175 |
| 2006/0118258 | A1 * | 6/2006 | Chmielewski | D21H 21/22 162/158 |
| 2009/0199349 | A1 * | 8/2009 | Weinstein | D06M 15/263 8/120 |
| 2011/0209839 | A1 * | 9/2011 | Leithem | C08L 1/00 162/90 |
| 2013/0206349 | A1 * | 8/2013 | Nonni | D21C 9/007 162/158 |
| 2020/0308766 | A1 * | 10/2020 | Hajnal | D21C 9/18 |

* cited by examiner

TREATED PULP AND METHODS OF MAKING AND USING SAME

BACKGROUND

Certain consumer products that include cellulose pulp fibers, such as absorbent products, require the fibers to be compressible and densified, while at the same time maintaining fiber matrix softness. Accordingly, cellulose pulp fibers may be treated with a densifying agent and provided in sheet form to the producer of such products. Pulp sheets are typically fiberized—that is, broken up into individual fibers—to produce a fiber matrix to be incorporated into an absorbent product. Fiberization is a process in which the energy and time required for fiberization is balanced against an acceptable level of knots (also sometimes referred to as "nits" in the industry and herein)—that is, fiber bundles and other pieces of the pulp sheet not fully broken apart during the fiberization process—in the fiberized product. Many effective densifying agents, such as glycerine, may also act as binding agents as a result of their viscous and somewhat adhesive character, and are useful in some applications for binding particles, such as super absorbent polymer ("SAP") to the fibers. However, due to these characteristics, it can be more difficult to achieve an acceptably low knots level during fiberization with pulp that has been treated with a densifying agent. Therefore a need exists for pulp fiber sheets that have been treated with a densifying agent that are more easily separable.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with aspects of the present disclosure, fiberizing a pulp sheet that includes hydrogen-bonded cellulose fibers treated with a densifying agent that is present in the pulp sheet in an amount between 1 and 20 weight percent, when the moisture content of the pulp sheet is from 0 to 9 percent, results in a fiberized pulp having an unexpectedly low knot content, while maintaining density and softness properties usually associated with similarly treated pulp that is fiberized at higher moisture levels.

Thus, in accordance with certain aspects of the present disclosure, a pulp sheet is provided. The pulp sheet includes hydrogen-bonded cellulose fibers treated with a densifying agent, in which the densifying agent is present in the pulp sheet in an amount from 1 to 20 weight percent. The pulp sheet, when fiberized at a moisture content from 0 to 9 percent in accordance with the Fiberization Test discussed below, produces a fiberized pulp having a knots level of less than or equal to 11.2%.

In accordance with certain aspects of the present disclosure, a pulp sheet is provided. The pulp sheet includes hydrogen-bonded cellulose fibers treated with a densifying agent, has a moisture content from 0 to 9 percent, and the densifying agent is present in the pulp sheet in an amount from 1 to 20 weight percent.

In accordance with certain aspects of the present disclosure, a method of producing fiberized pulp is provided. The method includes fiberizing a pulp sheet comprising hydrogen-bonded cellulose pulp fibers treated with 1 to 20 weight percent of a densifying agent, while the moisture content of the pulp sheet is from 0 to 9 percent.

The concepts, features, methods, and component configurations briefly described above are clarified with reference to the accompanying drawings and detailed description below.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
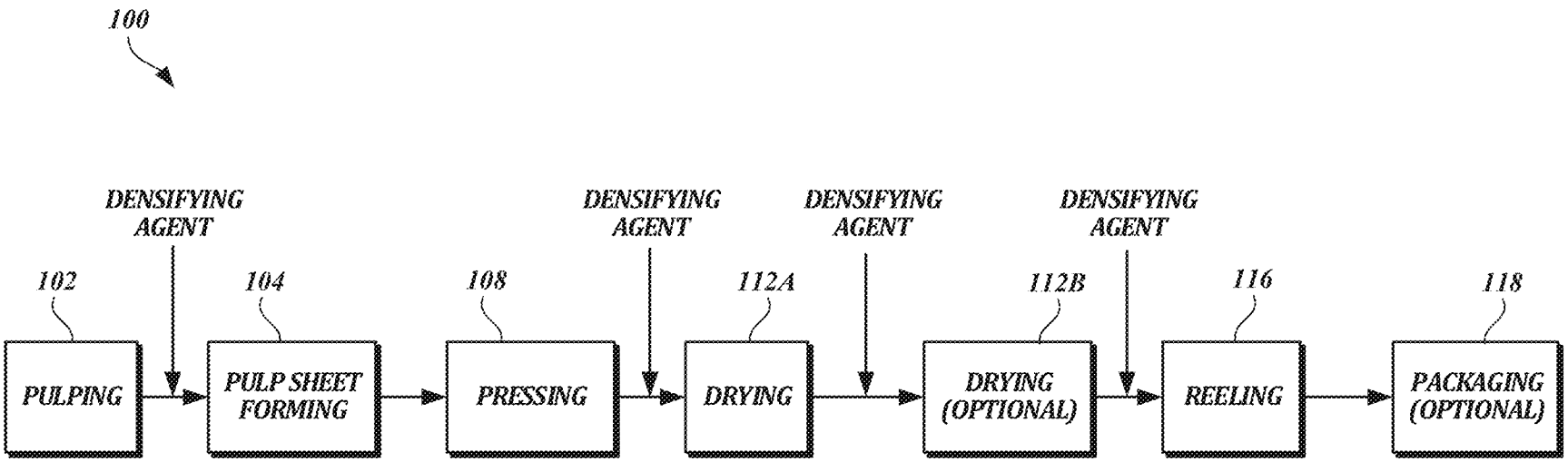
FIG. 1 illustrates a representative production process for a pulp sheet treated with a densifying agent in accordance with aspects of the present disclosure.

The following discussion provides examples of pulp fibers, generally in sheet form, treated with a densifying agent in order to realize desirable characteristics for one or more intended applications, and methods of producing a fiberized, treated pulp. In accordance with certain aspects of the present disclosure, fiberizing a pulp sheet that includes hydrogen-bonded cellulose fibers treated with a densifying agent that is present in the pulp sheet in an amount between 1 and 20 weight percent, when the moisture content of the pulp sheet is from 0 to 9 percent, results in a fiberized pulp having an unexpectedly low knot content. In some embodiments, the low knot content is achieved while maintaining one or more properties, such as density, softness, and so forth, usually associated with similarly treated pulp that is fiberized at higher moisture levels.

Examples of cellulose fibers treated with densifying agents are discussed in U.S. Pat. No. 5,789,326 to Hansen et al., the entire disclosure of which is incorporated herein by reference. Fibrous products, such as pulp sheets, may be densified by external application of pressure, such as to produce a densified product that may be more compact and/or more easily transported as compared to a non-densified product. Application of suitable densifying agents to the cellulose pulp fibers can enable easier densification of fibrous products incorporating the treated fibers. This includes not only pulp sheets made from the treated fibers, but also fibrous matrices and other constructions (e.g., absorbent cores for various absorbent products such as infant diapers and feminine hygiene products) that may be produced after fiberizing such pulp sheets.

The desired final moisture content of a manufactured pulp sheet, such as a pulp sheet incorporating hydrogen-bonded cellulose pulp fibers treated with a densifying agent, may be as desired, and often considers factors such as shipping costs, drying costs, customer specifications, degradation (such as of particles that may be bound to the fibers), suppression of bacterial growth during transportation and/or storage of the pulp sheet, and so forth. Typically, the moisture content is no more than about 10% by weight of the fibers, but is often lower, such as no more than about 6% to 8% by weight.

Regardless of the desired final moisture content of a manufactured pulp sheet, however, its moisture content may vary during transportation and/or storage, for example owing to the absorbent nature of the cellulose fibers and the ambient conditions. Moreover, the moisture content of a pulp sheet is often intentionally adjusted by the user, relative to the moisture content upon manufacture, to facilitate certain production processes. For example, as noted above, pulp sheets are typically fiberized, such as in order to produce airlaid fibrous structures (e.g., absorbent cores and the like). This is often done by feeding a pulp sheet of a certain width through a hammermill. Moistening a pulp sheet prior to fiberization is known to increase the efficiency of many fiberizing processes and optimize softness. However, too much moisture may weaken the sheet integrity. Consequently, a moisture content of about 10% is conventionally used for fiberizing pulp sheets treated with a densifying agent. According to conventional thinking, fiberizing such a pulp sheet at a moisture content of lower than 10%, in addition to eliminating these benefits, would also be expected to result in higher knots, due to the viscous and sticky nature of most densifying agents. However, as noted above, it has unexpectedly been found that fiberizing such pulp sheets at a moisture content of 0 to 9% produced fiberized pulps with unexpectedly low knot content.

Cellulose Pulp

In certain embodiments, the pulp used to form the pulp sheets of the present disclosure includes cellulose pulp or wood pulp. "Cellulose pulp" or "wood pulp" as used herein refers to the product resulting from the wood pulping process, and may be referred to herein as simply "pulp" unless otherwise noted. The wood pulping process can be either mechanical, chemical, or both (e.g., hybrid processes such as chemithermomechanical pulping (CTMP)). The pulped fibers can be bleached or non-bleached. In some embodiments, the chemical process known as "Kraft pulping" is employed, although other chemical pulp processing, such as sulfite processing, can be employed. Kraft and sulfite wood pulping processes are known to those of skill in the art and will not be discussed in detail herein.

The raw materials in some embodiments are sources of cellulose, hemicellulose and lignin and the terms "wood" or "tree" is used herein to generically describe any source of cellulose, hemicellulose and lignin. In the wood pulping industry, trees are conventionally classified as either hardwood or softwood. "Fluff pulp" is wood pulp generally prepared from long fiber softwood trees by a chemical wood pulping process, and it also is usually bleached during or after the wood pulping process. Examples of softwood species from which fluff pulp is formed include, but are not limited to: fir such as Douglas fir and Balsam fir; pine such as Eastern white pine and Loblolly pine; spruce such as White spruce; larch such as Eastern or Siberian larch; cedar; and hemlock such as Eastern and Western hemlock. In certain embodiments, the pulp is a northern bleached softwood kraft (NB SK) pulp. Alternatively, pulps in some embodiments of the present disclosure may also utilize hardwoods as the source of wood for the pulp, or a combination of softwood and hardwoods.

While the various aspects of the present disclosure are presented in terms of examples related to pulp derived from wood, it will be appreciated that the disclosed examples are illustrative in nature, and therefore, should not be construed as limited to wood pulp applications. It should therefore be apparent that these various aspects of the present disclosure have wide application, and can be employed with pulp derived from any source, such as fiber crops, etc.

In one embodiment, the pulp sheet has a basis weight of at least 300 $g/m^2$.

Densifying Agent

In certain embodiments, the pulp sheets suitable for realizing aspects of the present disclosure also include a densifying agent. Suitable densifying agents include those described in U.S. Pat. No. 5,547,541 to Hansen et al., which is incorporated herein by reference in its entirety to the extent not inconsistent with the present disclosure. The densifying agent includes at least one functional group that is capable of forming a hydrogen bond with cellulosic fibers. Some densifying agents further include a second functional group capable of forming a hydrogen bond or a coordinate covalent bond with a particle (e.g., a superabsorbent polymer) such as those that may be combined with treated fibers to form absorbent articles. Densifying agents that may be used to bind particles to fibers in this manner are also referred to as binders.

The densifying agent is present in the pulp sheet in an amount from about 1 to about 20 percent by weight of the pulp sheet as determined by oven dried mass, such as in an amount from about 5 to about 10 weight percent, or an amount from about 6 to about 9 weight percent, or an amount from about 6.5 to about 8 weight percent or in an amount within any other sub-range of the aforementioned ranges. As used herein, the expression "from X to Z" encompasses any value or values, or range of values, between X and Z, such as Y, as well as the values X and Z.

Suitable densifying agents include polymeric and nonpolymeric densifying agents. Included among the nonpolymeric densifying agents are organic and inorganic densifying agents. Other suitable densifying agents include materials that are hygroscopic in nature.

Polymeric densifying agents include polymeric compounds having at least one hydrogen bonding functionality. In accordance with the present invention, the polymeric densifying agents can be a polyglycol, a polycarboxylic acid or polycarboxylate, a poly(lactone) polyol, a polyamide, a polyamine, a polysulfonic acid or a polysulfonate, combinations thereof, and copolymers that include nonhydrogen bonding monomer units in the polymeric chain. Specific examples of certain of these densifying agents include: polyglycols such as polypropylene glycol and polyethylene glycol; poly(lactone) polyols such as poly(caprolactone) diol; polycarboxylic acids such as polyacrylic acid; polyamides such as polyacrylamide and polypeptides; polyamines such as polyethylenimine and polyvinylpyridine; polysulfonic acids or polysulfonates such as poly (sodium-4-styrenesulfonate) and poly(2-acrylamido-methyl-1-propanesulfonic acid; and copolymers thereof (for example, a polypropylene glycol/polyethylene glycol copolymer).

Suitable densifying agents useful in the present invention also include nonpolymeric organic densifying agents. Suitable nonpolymeric organic densifying agents include compounds having at least one functional group capable of forming a hydrogen bond with the fibers. In accordance with the present invention, organic densifying agents can include a functional group selected from a carboxyl or carboxylate group, a carbonyl group, a sulfonic acid or sulfonate group, a phosphoric acid or phosphate group, a hydroxyl group, an amide group, an amine group, and combinations of these groups (e.g., an amino acid or hydroxy acid).

Suitable organic densifying agents also include alcohols including primary, secondary, and tertiary alcohols; polyols such as glycols (dihydric alcohols), ethylene glycol, propylene glycol and trimethylene glycol, and triols such as glycerine (1,2,3-propanetriol); other polyols such as sorbitol (i.e., 1,2,3,4,5,6-hexanehexol); amino alcohols such as ethanolamine (2-aminoethanol) and diglycolamine (2-(2-aminoethoxy)ethanol). Other suitable organic densifying agents include nonpolymeric polycarboxylic acids such as citric acid, propane tricarboxylic acid, maleic acid, butanetetracarboxylic acid, cyclopentanetetracarboxylic acid, benzene tetracarboxylic acid, ascorbic acid, tartaric acid, and their salts. Esters of hydroxyl-containing densifying agents can also be used, with mono- and diesters of glycerine, such as monoglycerides and diglycerides, being preferred. Other densifying agents include hydroxy acids such as hydroxyacetic acid, lactic acid, tartaric acid, ascorbic acid, citric acid, and salicylic acid, and their salts; amino acids such as glycine, alanine, valine, serine, threonine, cysteine, glutamic acid, lysine, and β-alanine, asparagine, and glutamine; sulfonic acids and sulfonates; amino-sulfonic acids such as taurine (i.e., 2-aminoethanesulfonic acid); polyamides such as oxamide, urea and biuret; and polyamines such as ethylene diamine and EDTA.

In some embodiments, the densifying agent is a combination of densifying agents.

Thus, in some embodiments of pulp sheets suitable for realizing aspects of the present disclosure, the densifying agent is selected from the group consisting of a polyglycol, a polycarboxylic acid, a polycarboxylate, a poly(lactone) polyol, a polyamide, a polyamine, a polysulfonic acid, a polysulfonate, an alcohol, a polyol, an amino alcohol, an amino acid, a hydroxy acid, a salt of such a hydroxy acid, an ester of any of the aforementioned materials that contain a hydroxyl group, an inorganic salt in which the cation is monovalent, and combinations and mixtures thereof. In some embodiments, the densifying agent is selected from the group consisting of glycerine, propylene glycol, sorbitol, lactic acid and its monovalent cation salts, and urea. In some embodiments, the densifying agent includes glycerine.

Production of Pulp Sheets from Cellulose Fibers Treated with Densifying Agent

Pulp sheets suitable for realizing aspects of the present disclosure can be formed by a variety of conventional pulp sheet and paper manufacturing methods including handsheet and manufacturing line forming methods. One common manufacturing method is a wet-laid pulp sheet manufacturing process that may be integrated as a part of a wood pulping process.

For example, FIG. 1 illustrates, in block diagrammatic form, one representative process 100 for forming pulp sheets suitable for aspects of the present disclosure. Process 100 includes pulping 102, pulp sheet forming 104, pressing 108, and one or more stages of drying 112. The process may also include reeling 116, in which the pulp sheet is wound into roll form, and packaging 118, in which the pulp sheet is wrapped or otherwise packaged, preferably in a water impermeable packaging, e.g., polyethylene. The forming of pulp sheets begins with pulping 102, in which pulp raw materials, such as wood, fiber crops, etc., are pulped in, for example, a chemical wood pulping process. The chemical wood pulping process can be any conventional wood pulping process that arrives at pulp fibers, such as Kraft pulping, sulfite pulping, etc. The slurry of pulped fibers can then be optionally bleached with chlorine or chlorine-free compounds, for example.

The pulp slurry resulting from pulping 100 is then poured onto a moving screen at pulp sheet forming 104 in order to form a pulp sheet. As the pulp slurry travels on the moving screen, one or more processes may occur to remove moisture from the pulp slurry. For example, a mechanical press can be used to force liquid out of the pulp at pressing 108, and/or heat, air flow, etc., can be employed at drying 112, to remove liquid from the pulp. Drying 112 can be carried out in one or more stages, including a first stage of drying 112A and a second stage of drying 112B. The removal of moisture tends to collapse the fibers and produce hydrogen bonds between adjacent fibers, resulting in a pulp sheet, which may then be rolled into roll form at reeling 116.

Optionally, the pulp sheet in roll form may be packaged, at packaging 118. A variety of packaging methods may be used, such as the use of moisture-impermeable materials including polyethylene and other polymer-based wrapping, for example, to completely wrap a rolled pulp sheet of desired dimensions.

Pulp sheets suitable for realizing certain aspects of this disclosure incorporate hydrogen-bonded cellulose pulp fibers treated with a densifying agent of the type described above.

Accordingly, in some embodiments in accordance with this disclosure, a densifying agent is added to the pulp fibers. As noted above, the term "densifying agent" encompasses embodiments in which one densifying agent is used, as well as embodiments in which two or more different densifying agents are used (such as separately and/or in mixtures). A detailed description of one production method of pulp sheets treated with a densifying agent can be found, for example, in the aforementioned '326 patent. Simplified, a densifying agent can be added to the pulp fibers during the pulp sheet forming process. For example, the densifying agent can be added before pulp sheet forming 104, when the pulp is in a slurry, after pressing 108, when fluid from the wood pulping process is pressed out of the fluff pulp, and/or after the first and/or second stages of drying 112A, 112B, where additional moisture is removed from the pulp. When adding the densifying agent before pulp sheet forming 104, the densifying agent may be in a dispersed or emulsified form. When adding the densifying agent to the pulp sheet after pressing and/or drying, techniques including but not limited to spraying, roll coating, showering, and/or immersion techniques may be employed. In some embodiments, the densifying agent may be in a melted or neat form.

Figure 3:
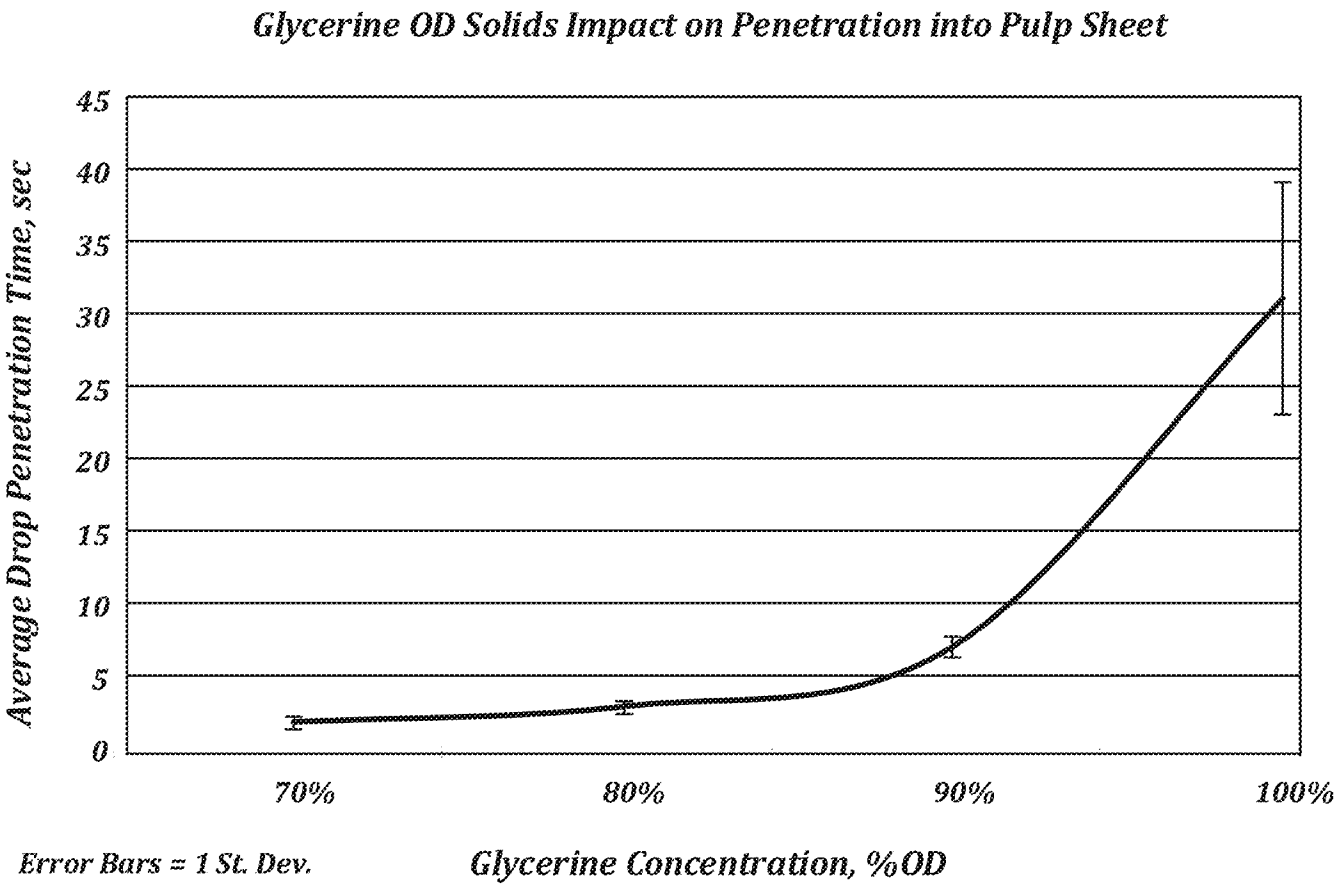
FIG. 3 depicts Glycerine Oven Dried Solids impact on penetration into a pulp sheet.

The application technique(s) may be determined at least in part by the densifying agent applied to the pulp sheet. For example, a non-aqueous densifying agent, such as glycerine, can be added downstream from a drying stage, or during a drying stage. Liquid non-aqueous densifying agents also may be added upstream of a drying stage. At this latter location, the water in the wet fiber web at this point may tend to attract such densifying agents into the mat or sheet and onto the constituent fibers, as the densifying agents tend to be hydroscopic. Optionally, the densifying agent may be diluted, for example to make the material easier to pump or handle, to promote penetration into the web or sheet, and so forth. The dilution level often represents a trade-off between the level of dilution required to realize these benefits, and the increased energy and/or time to remove the additional moisture in order to reach the desired final moisture content of the pulp sheet. In embodiments in which glycerine is used, if it is applied neat or at too high in concentration, it can take a long time for it to penetrate the sheet. This is especially important given the relatively short time that may exist in commercial settings between an application point and when the sheet reaches the jumbo on the machine reel. FIG. 3 shows that above about 85-90% OD (oven dried mass) solids the glycerine penetration time increases rapidly. In some embodiments in which glycerine is used as the densifying agent, the glycerine is diluted to a concentration in the range of about 65-90% OD solids and applied to a pulp sheet downstream of the drying stage and prior to reeling, via a sprayer assembly. Preferably, the glycerine is diluted to a concentration in the range of about 70-80% OD solids. More preferably, the glycerine is diluted to a concentration of about 80% OD solids. In another embodiment, the glycerine is less than or equal to 90% OD solids. In yet another embodiment, the glycerine is from about 70% OD to less than or equal to 90% OD solids. In yet another embodiment, the glycerine is from about 70% OD solids to less than or equal to 80% OD solids. As an added benefit, the viscosity of the glycerine is lower when diluted with water and slightly heated, thus helping with pumping and handling.

Figure 2:
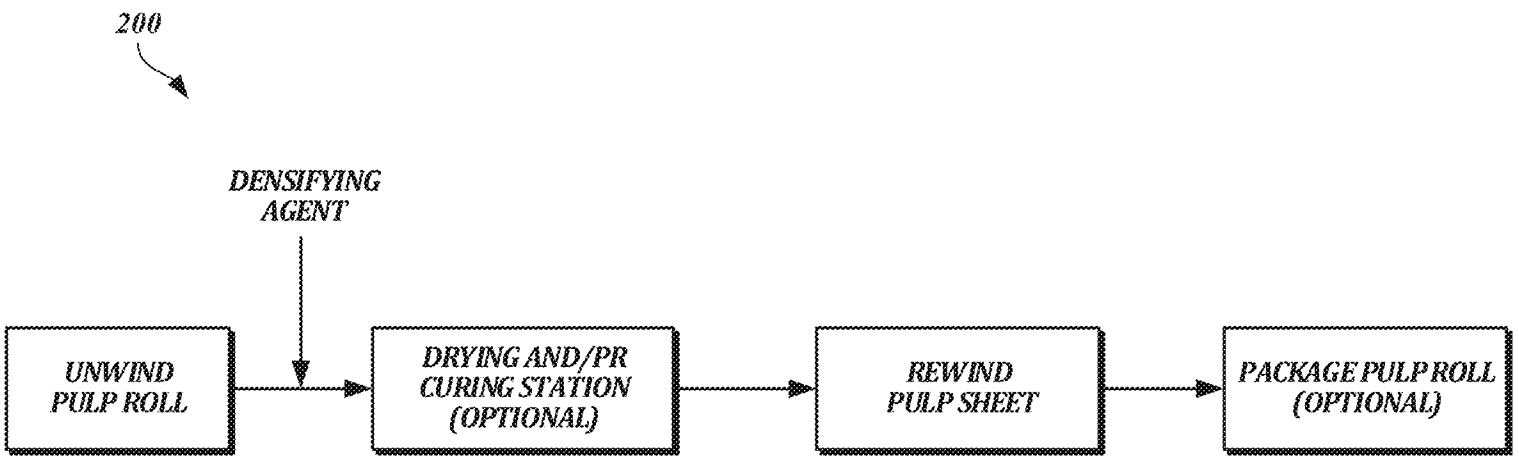
FIG. 2 illustrates a representative post production process for adding a densifying agent to a pulp sheet in roll form in accordance with aspects of the present disclosure.

In some embodiments, a densifying agent may be additionally or alternatively added to post processed pulp (e.g., after the fluff pulp sheets are reeled into roll). In such embodiments, the rolled pulp sheet can be unwound at a pulp roll unwind stand, treated with a densifying agent via spray, shower, dipping, and/or other techniques as mentioned above, and then rerolled into roll form by a rewinder, as shown in the process 200 of FIG. 2. Optional processes may be carried out after the densifying agent is added. For example, the treated pulp sheet can be dried with an optional dryer or cured at an option curing station. Similar to process 200, the (re)rolled pulp sheet may optionally be packaged.

In general, whether or not a rolled pulp sheet is packaged depends on several factors, such as expected transportation and storage demands, customer requirements, whether the pulp is treated with any additives or agents, and so forth. Moreover, the type and manner of packaging may vary based at least in part on some of these factors. As explained in detail below, it has unexpectedly been found that fiberizing a pulp sheet that includes hydrogen-bonded cellulose fibers treated with a densifying agent that is present in the pulp sheet in an amount between 1 and 20 weight percent, when the moisture content of the pulp sheet is from 0 to 9 percent, results in a fiberized pulp having an unexpectedly low knot content.

Accordingly, in some embodiments of the present disclosure, a pulp product includes such a pulp sheet, packaged in packaging that is configured to maintain the moisture content at a desired level from 0 to about 9 percent, such as from about 5 to about 8 percent, or at a different moisture content or sub-range within the range. A variety of packaging methods may be used, such as the use of moisture-impermeable materials including polyethylene and other polymer-based wrapping, for example, to completely wrap a rolled pulp sheet of desired dimensions.

In some embodiments, the moisture content of the treated pulp sheet is adjusted to a desired level from 0 to about 9 percent prior to packaging, for example from about 5 to about 8 percent, or at a different moisture content or sub-range within the range, such as during a drying stage as shown in process 100 or 200. In some of such embodiments, in which the treated pulp sheet is packaged at that point, the packaging may maintain the moisture content of the pulp sheet at that level until it is removed from the packaging by the user, such as to subject the treated pulp sheet to fiberization and processing.

However, as noted above, the conventional expectation is that fiberizing a pulp sheet treated with 1-20 weight percent of a densifying agent, while the moisture content of the pulp sheet is lower than 10%, would lead to higher knots and overall greater difficulty in processing and handling. Accordingly, although packaging methods are known, a pulp product comprising such a treated pulp sheet that is packaged to maintain the moisture content of 0 to about 9% is not previously known to be available. Such a packaged product may assist the user of the treated pulp sheet in that the moisture content of the pulp sheet may require less adjustment—or even no adjustment—prior to fiberization, in order to realize the benefits of fiberizing the pulp sheet at the low moisture levels discussed herein.

Packaged or not, the unexpectedly low knot content in fiberized pulp is realized when a pulp sheet treated with a densifying agent in the manner discussed herein is fiberized at a moisture content from 0 to about 9%. As noted above, it is not uncommon for producers of absorbent articles and other customers of treated pulp to adjust the moisture content of a pulp sheet prior to fiberization—such as by wetting or drying the pulp sheet, as appropriate—to reach a desired moisture content for fiberization. That said, the conventional expectation with a pulp sheet treated with 1-20 weight percent of a densifying agent, while the moisture content of the pulp sheet is lower than 10%, would lead to higher knots and overall greater difficulty in processing and handling. Accordingly, some methods of producing a fiberized pulp in accordance with the present disclosure include fiberizing a pulp sheet comprising hydrogen-bonded cellulose pulp fibers treated with 1 to 20 weight percent of a densifying agent, while the moisture content of the pulp sheet is from 0 to about 9 percent.

In some of such methods, the moisture content of the pulp sheet is reduced or otherwise adjusted to achieve a moisture content from 0 to about 9 percent prior to fiberizing the pulp sheet, for example from about 5 to about 8 percent, or at a different moisture content or sub-range within the range, such as by means of a drying procedure and/or a wetting procedure, similar to those described above with respect to process 100 or 200.

In certain embodiments, the fiberized pulp can be characterized based on various testing methods, as disclosed below. In another embodiment, the fiberized pulp has a Carver density from 0.2 to 0.3 g/cm$^3$ at 150 psi. In another embodiment, the fiberized pulp has a cantilever stiffness from 4.0 to 8.0 cm, as tested with a basis weight of 600-700 gsm, the pad formed without SAP, and a pad density of 0.12 g/cc.

Test Methods

In the non-limiting examples that follow, the following test methods were employed to determine various reported characteristics and properties of the treated pulp sheets. ASTM refers to the American Society of Testing and Materials.

Fiberization energy testing is used to measure the amount of energy required to fiberize a pulp sheet. The knots content of pulp fiberized during such testing can also be determined.

The "Fiberization Test" referred to herein is performed according to the following procedure in which the energy requirement is determined using a laboratory scale hammermill instrumented to measure power necessary to fiberize a given weight of pulp. The mill used was a Kamas Laboratory Mill, Model H01, manufactured by Kamas Industri, AB, Vellinge, Sweden. For testing the pulp sheet samples described below, the hammermill was equipped with a screen having 19 millimeter (mm) round holes. During testing, the breaker bar clearance of the mill was set to 4.0 mm, the rotor speed was adjusted to 3024 revolutions per minute (rpm), and the pulp feed rate was 2.80 grams/second.

Pulp sheet samples to be tested were cut into strips 5.0 cm wide and as long as the sample will permit. Strips were conditioned at 50% relative humidity (RH) for a minimum of 4 hours prior to testing. Sufficient strips were cut to yield about 150 g of fiberized pulp. The basis weight of the samples was known and the hammermill feed roller speed was adjusted to achieve the aforementioned target feed rate.

Knot percentage testing is used to measure the percentage of knots. Fluff generated by the test hammermill during the fiberization process described above was tested for knots content with a Defiberization Efficiency (DE) test apparatus manufactured by Courtray Consulting Labservice, 2 rue Charles, MONSARRAT, 59500 Douai, France. This device uses a series of standard ASTM mesh screens to separate fluff into knots and accepts. In this test procedure, knots are the fraction that is retained on an ASTM 12 mesh screen.

Other fiberization test methods may be used to quantitatively measure percentage of knots in a fiberized fluff, and these methods are well-known in the industry. One exemplary method of testing is the "pocket former DE test," which includes the following conditions.

The hammermill on the pocket former has the following operational characteristics, any similar mill operating under similar conditions may be used. This hammermill defiberized the sample fluff pulp roll sheets for the DE test. Percent accepts, fines, and knots are determined as previously described above. Pocket former conditions:

- Fixed chevron-type rotor of 11.25 inches diameter, 5.5 inches wide.
- Breaker bar gap (distance between rotor tips and stator)=1 mm
- Tip speed—around 17,000-18,000 feet per. minute
- Sheet feed rate—10 ft/min Another quantitative method for testing knot content is SCAN-CM 37:85, promulgated by the Scandanavian Pulp, Paper, and Board Testing Committee.

The density of a pulp matrix helps determine required pressures to achieve target densities. There are several ways to measure density values of a pulp matrix, such as an airlaid pad. Birch calendar density and Carver density are two methods discussed below.

Birch calendar density, as the term is used herein, is a density value determined in accordance with the following method.

A Birch calendar is a smooth (polished) surface calendar twin-roll press, provided with two rolls that are each 12" in diameter. The gap setting (between rolls) is measured using a "feeler" gauge and is adjusted depending on the resulting desired thickness of the pad. An airlaid sample pad is fed through the nip with the rolls running at a product feed rate speed of 10 ft/min. The caliper (thickness of the pad) is measured and the density is calculated after weighing the sample, as follows:

$$\text{Birch calendar density (g/cm}^3\text{)} = \text{weight of pad (g)} / [\text{Surface area of pad (cm}^2\text{)} \times \text{caliper (cm)}].$$

Carver density, as the term is used herein, is a density value determined in accordance with the following method.

A Carver press is provided with 15.2 cm×15.2 cm chrome plates. A 10 cm×10 cm sample airlaid pad is weighed and then placed between the chrome plates in the Carver press, and gradually compressed until the target pressure of 150 psi is reached. Once reached, the target pressure is held for approximately 20 seconds, at which point the distance between the inner surfaces of the chrome plates is measured. Carver density is calculated as follows:

$$\text{Carver density (g/cm}^3\text{)} = \text{weight of pad (g)} / [100\ \text{cm}^2 \times \text{caliper (cm)}]$$

The softness of a pulp matrix, such as an absorbent pad, is a desirable feature in pulp fibers. As softness is a subjective property, stiffness—i.e., resistance to bending—is often used as a surrogate measurement for softness.

Herein, stiffness is measured using the Cantilever stiffness test method described below. The lower the stiffness value (bend length) of a sample, the less stiff, or softer, it is.

Equipment needed:

- Cantilever frame with 45-degree angle of incline and metric scale attached to top edge. (Note: this is a modified apparatus, as the standard ASTM cantilever apparatus, as described in ASTM D 1388-96, has a 41.5-degree angle of incline and only accommodates 3.8 cm×20 cm samples.)
- Pad holding block—approximately 16.5 cm×7.5 cm×2 cm thick, made of light material such as Styrofoam. The block should weigh less than 25 g.
- Stopwatch.

Sample airlaid pads are cut to a maximum dimension of 6.5 cm×30 cm, and need not be conditioned prior to testing. A standard sample pad composition for testing cantilever stiffness is tested with a basis weight of 600-700 gsm, the pad formed without SAP, and a pad density of 0.12 g/cc.

A sample pad is placed on the top surface of the cantilever frame, aligning the front of the pad with the edge of the decline. The holding block is placed gently on the back of the pad gently (so as not to further densify the pad). The back edge of the holding block is aligned with the 0 mark or the end of the pad if the pad is shorter than standard length (for shorter pads, the starting point of the back edge of the holding block is recorded). The pad is then pushed forward in a smooth manner at a calibrated speed of approximately 4 cm/sec), keeping the side of the holding block along the edge of the metric scale. The block is held against the pad just hard enough to allow the pad to be pushed along the surface of the cantilever frame. Pushing is stopped when the front portion of the pad bends enough to touch the angled surface. The bend length from the linear metric scale is recorded (to the nearest 0.1 cm). For shorter samples, the bend length is calculated by subtracting the starting point from the final reading (Lf–Lo). The holding block is maintained in position on the pad, and is used to pull the pad back up to the top surface of the frame. The paid is carefully turned 180 degrees, keeping the same surface up (the pad is not turned over, and the procedure is repeated. The bending length, or Cantilever stiffness, is the average of 32 measurements from 16 sample pads of the same material.

Example 1

Figure 4:
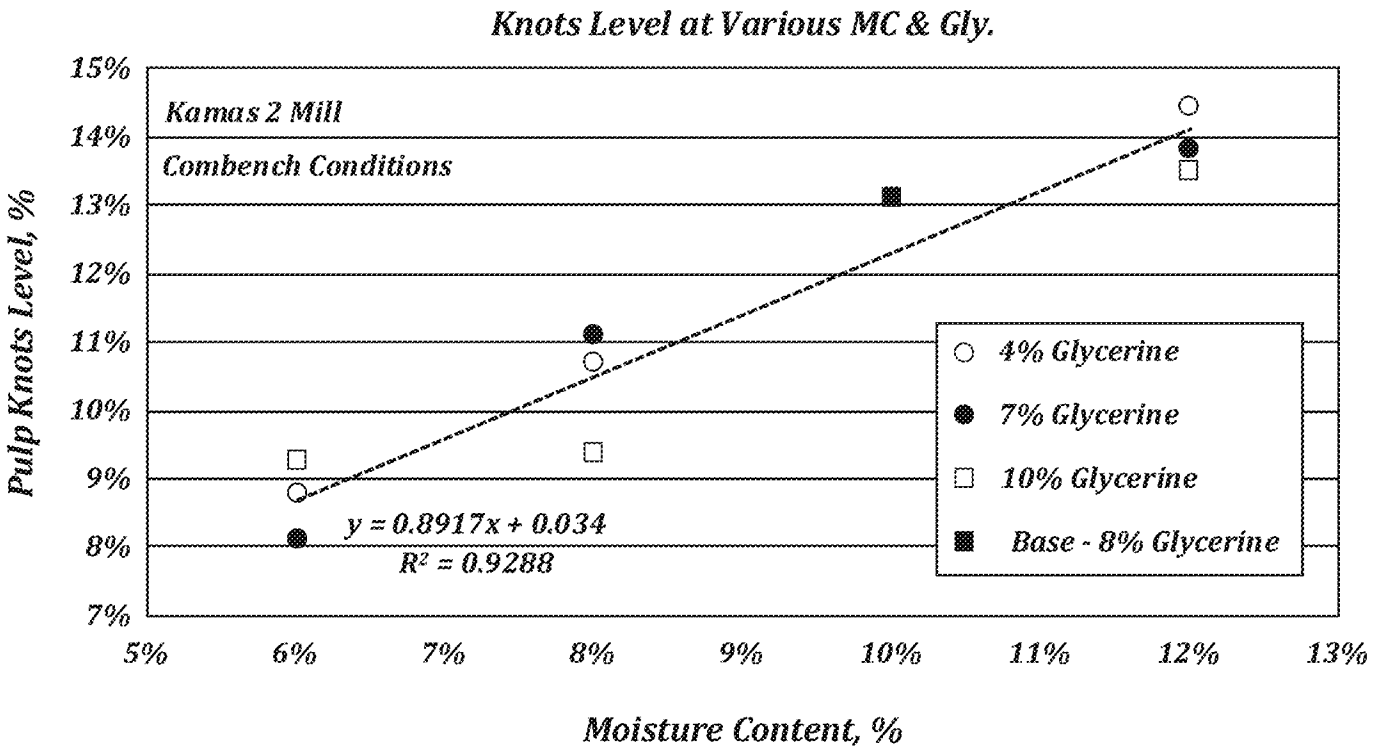
FIG. 4 is a line plot depicting knots levels at various moisture content and glycerine dosage levels of densifier treated FL 416 pulp.

Standard fluff pulp in sheet rolls (Flint River Mill "416 Pulp", International Paper Co., Memphis, Tenn.) was used to evaluate three moisture content ("MC") levels (12%, 8%, 6%) at three different glycerine dosages (10%, 7%, 4%). All "%" values of MC and glycerine in the Examples are weight percent of the treated fluff sheet (as OD, oven dried mass), unless otherwise expressly stated. In addition, a base comparison sample, at 10% MC and 8% glycerine, was evaluated as the reference point. All samples were evaluated for defiberized fluff knots. All samples were also evaluated for Carver density and Cantilever stiffness. The 10 samples in this Example 1 included:

1—4% glycerin at 12% MC
2—4% glycerin at 8% MC
3—4% glycerin at 6% MC
4—7% glycerin at 12% MC
5—7% glycerin at 8% MC
6—7% glycerin at 6% MC
7—8% glycerin at 10% MC
8—10% glycerin at 12% MC
9—10% glycerin at 8% MC
10—10% glycerin at 6% MC The results from Example 1 demonstrated a strong positive correlation ($r^2$=0.93) between the fiberized pulp knots level (percentage) and the starting sheet MC across the ranges evaluated, see FIG. 4. It was surprisingly found that about one percentage (absolute) change in the moisture content resulted in about one percentage (absolute) change in knots level (percentage) for the DE (Defiberization Efficiency) test. Results of the range from about 4% glycerine to about 10% glycerine and from about 6% MC to about 8% MC had surprisingly lower knots levels (percentage), ranging from about 8.2% to about 11.2% pulp knots level.

Figure 5:
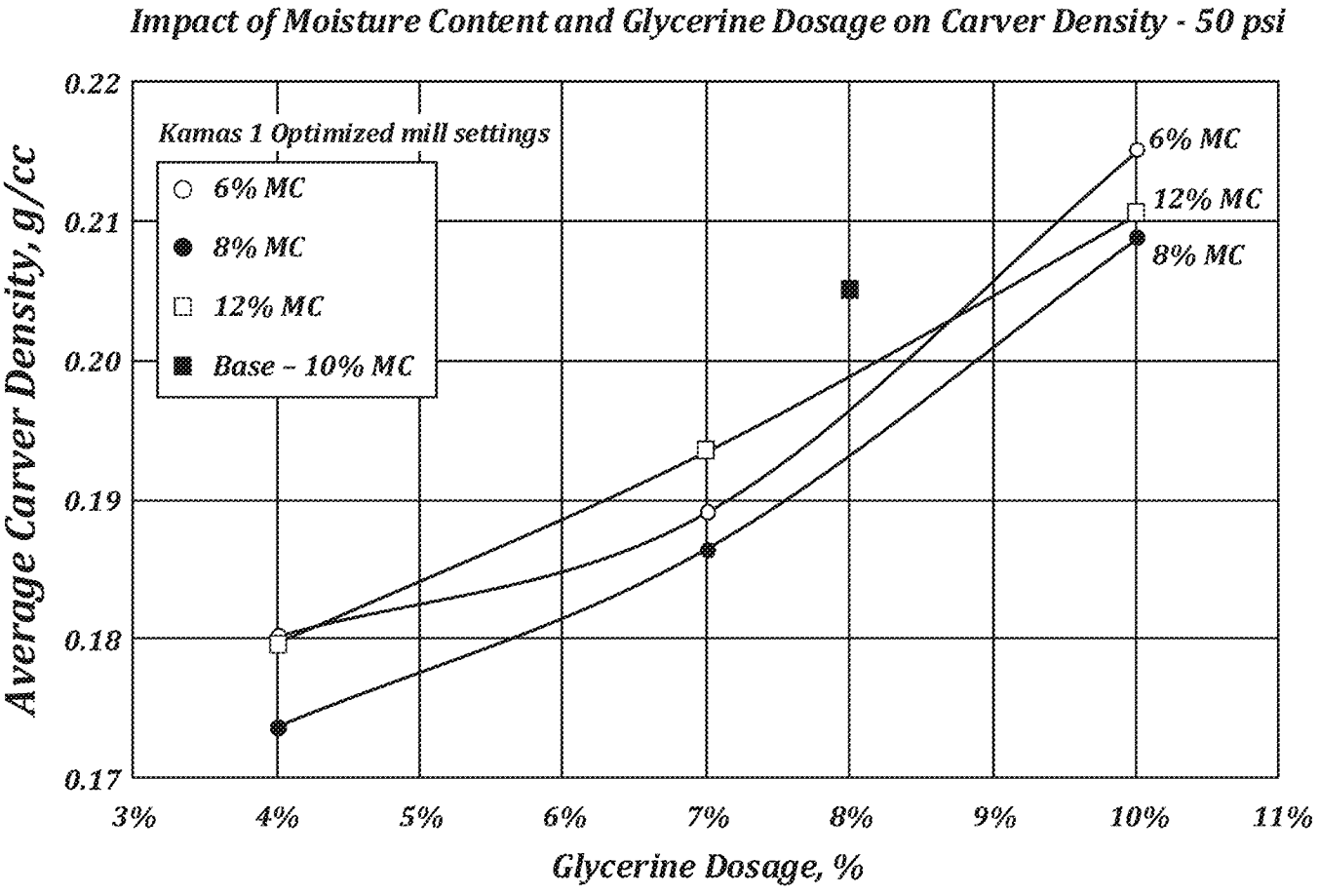
FIG. 5 is a graph plot depicting Carver Density at various moisture content and glycerine dosage levels of densifier treated FL 416 pulp at 50 psi.
Figure 6:
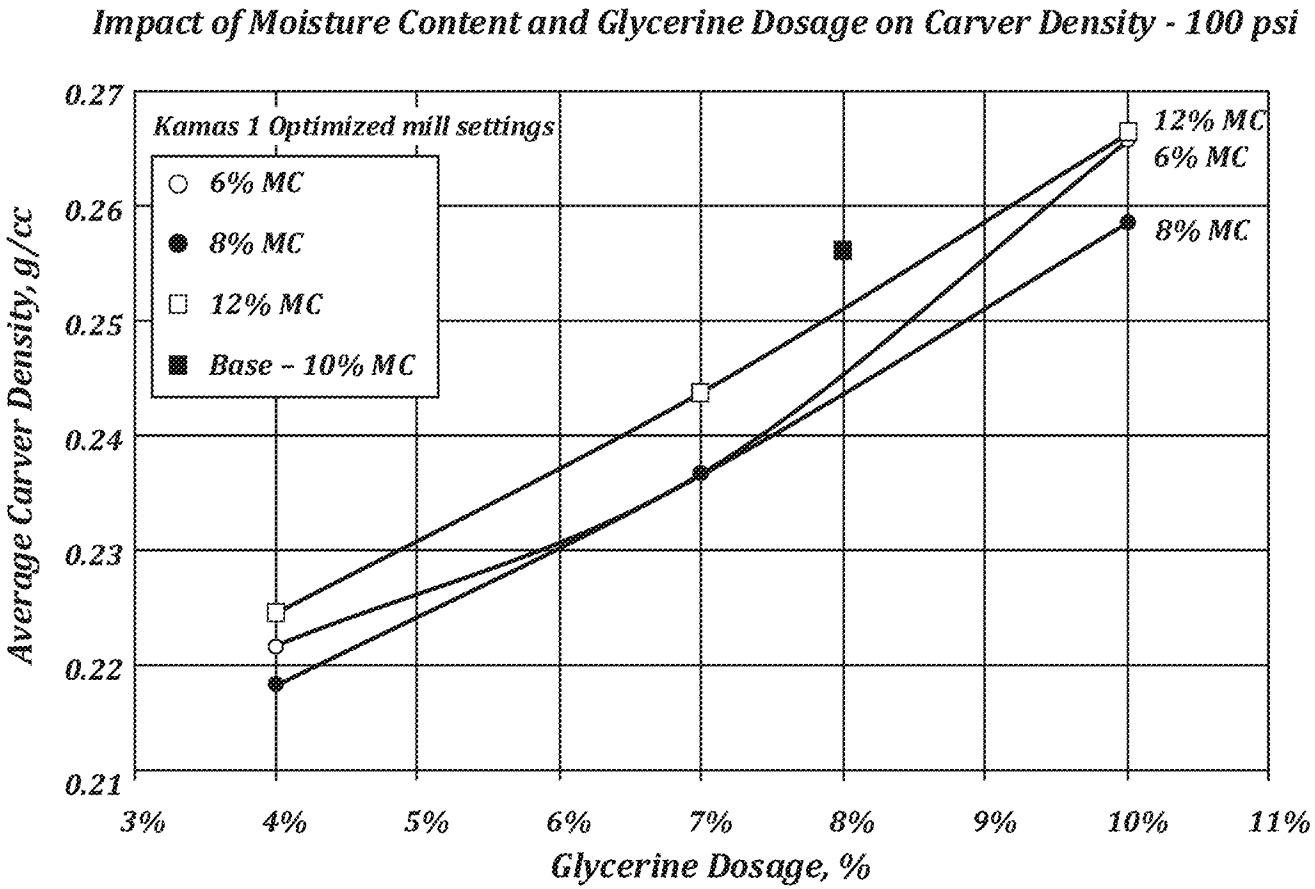
FIG. 6 is a graph plot depicting Carver Density at various moisture content and glycerine dosage levels of densifier treated FL 416 pulp at 100 psi.
Figure 7:
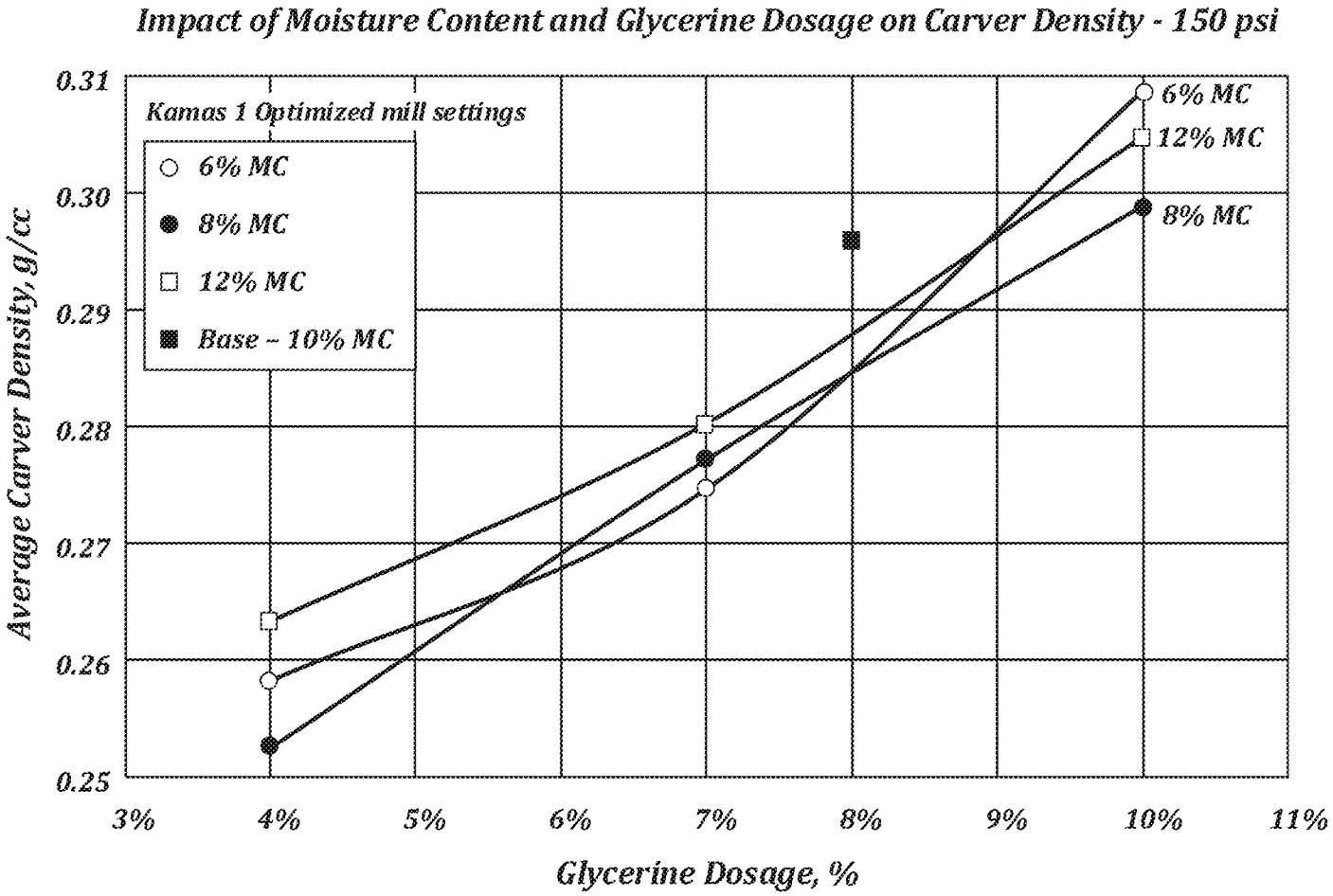
FIG. 7 is a graph plot depicting Carver Density at various moisture content and glycerine dosage levels of densifier treated FL 416 pulp at 150 psi.
Figure 8:
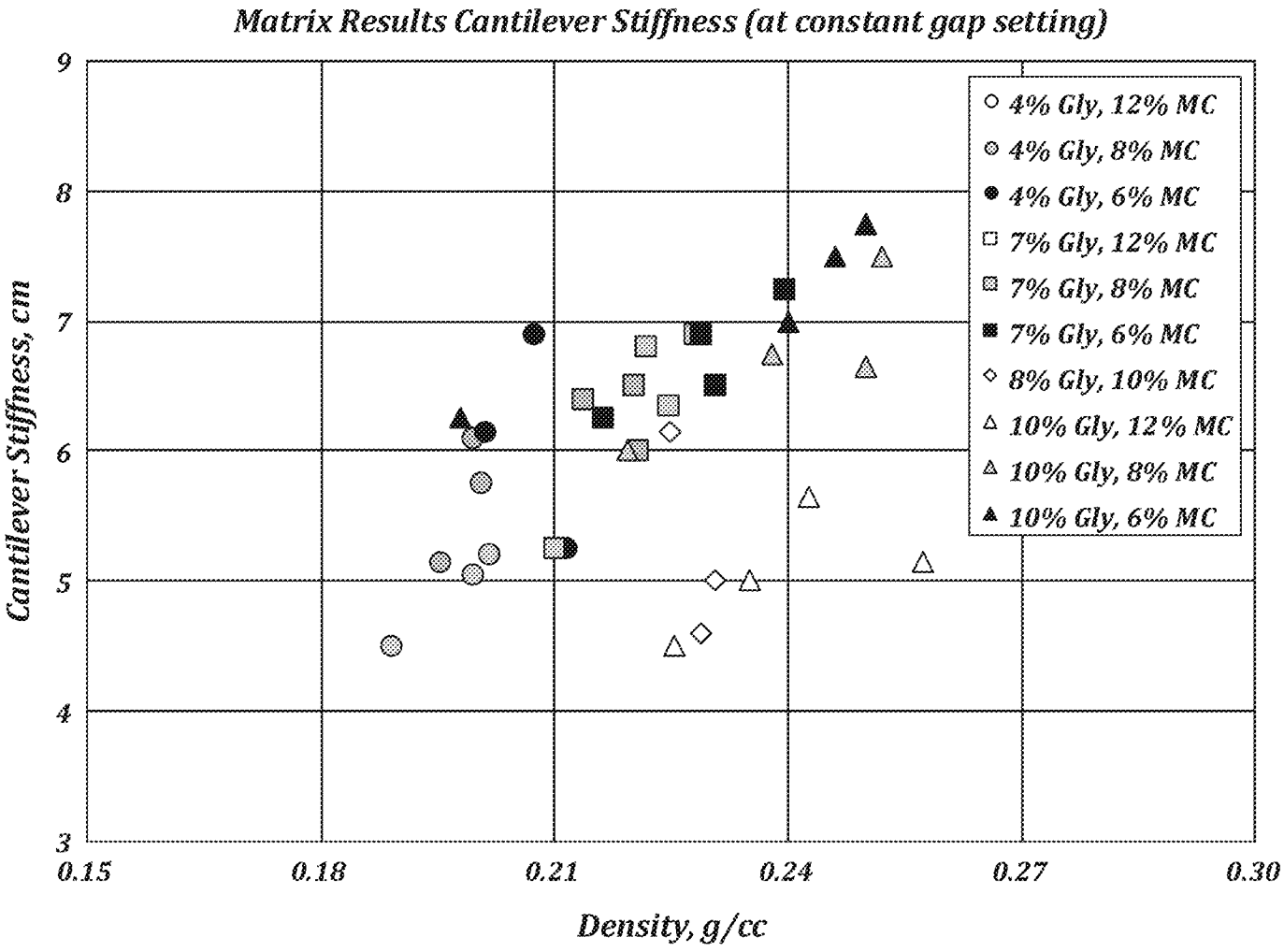
FIG. 8 is a scatter plot depicting Cantilever Stiffness at various moisture content and glycerine dosage levels of densifier treated FL 416 pulp.

Shown in FIGS. 5-7 are the Carver density results for the Example 1 at 50 psi, 100 psi, and 150 psi pressures, respectively. These data indicate that glycerine dosage has a greater impact on density than MC does. FIG. 8 demonstrates that MC has no real consistent impact on Cantilever stiffness results (but does show a general positive trend with density). These results surprisingly provide a general knots/nits reduction framework for density modified pulps in which MC is reduced while glycerine dosage is held constant, which results in lower fiberized knots being produced while maintaining the density and softness properties that are provided with the densified fluff pulp.

Example 2

Figure 9:
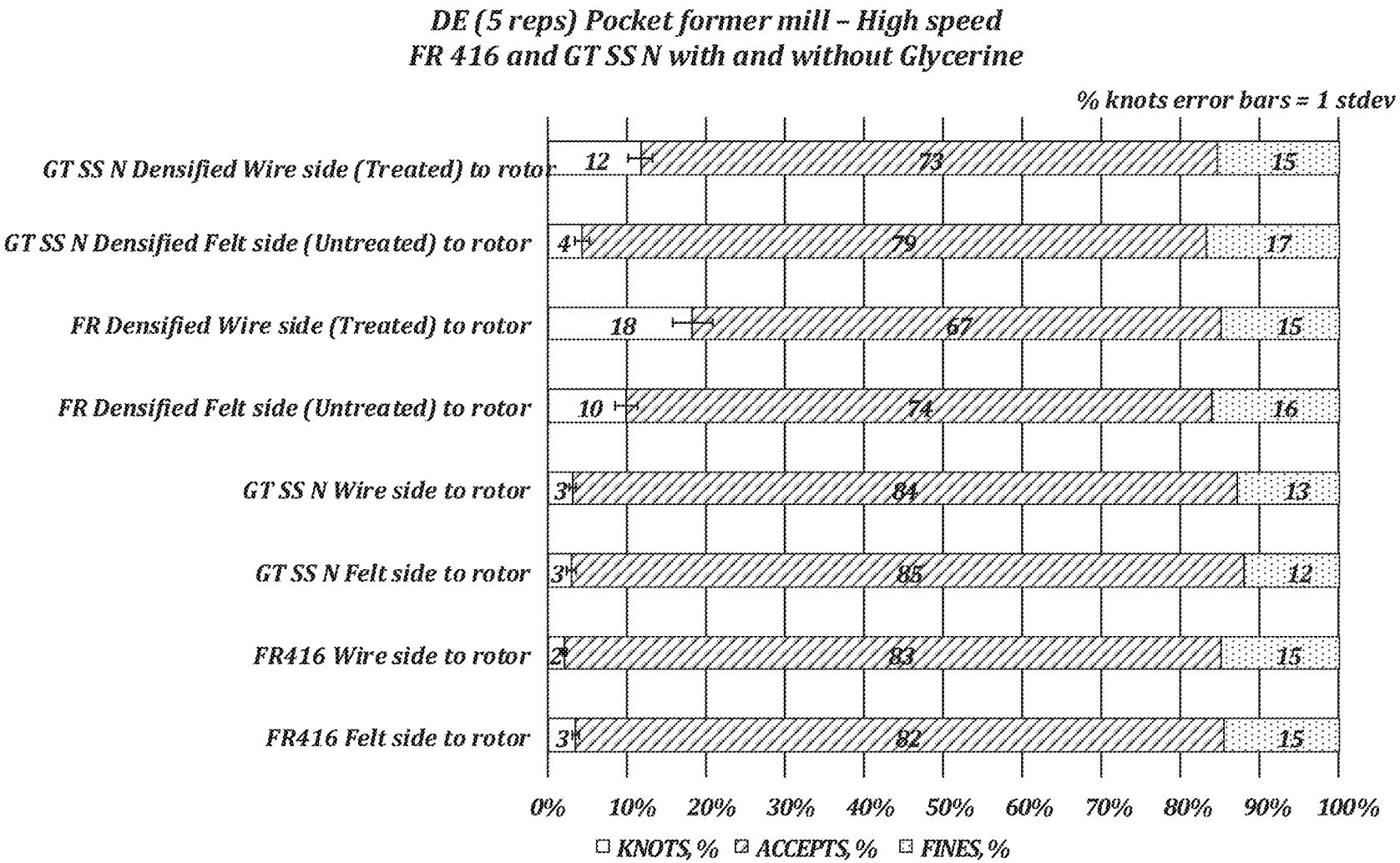
FIG. 9 depicts Defiberization Efficiency of densifier treated and control FL 416 and GT SS pulp rolls on a 100% scale using a high-speed pocket former mill Defiberization method.

A single level of 9.0% MC and a single glycerine dosage level of about 8% OD was applied to two standard fluff pulp in sheet rolls (Flint River ("FL" or "FR") Mill "416 Pulp" and Georgetown ("GT") Mill "SuperSoft® (SS) Pulp", International Paper Co., Memphis, Tenn.). In order to achieve same MC and densifying agent levels on fiber sheets with different starting moisture content, the glycerine was applied to the rolls at different dilutions and mass flow rates of a spray apparatus in conjunction with a roll winder (Caraustar, Tacoma, Wash.). Both FL and GT treated pulps were fiberized using a saw-tooth rotor defiberizer (Xingshi, China) and formed into pads. The DE tests were performed using pocket former defiberized pulps from the two treated pulps with both sides (treated and untreated) fed into the defiberizer on the rotor side as separate evaluation runs. FIG. 9 demonstrates that the densifier treated FL and GT pulps created higher knots than untreated pulp from the same rolls. Interestingly, the side facing the rotor (treated versus untreated) showed significant differences in knot/nit creation, with best (lowest knots/nits) generated with the untreated side to the rotor. No major difference is seen in the untreated pulps for wire or felt side comparisons.

Figure 10:
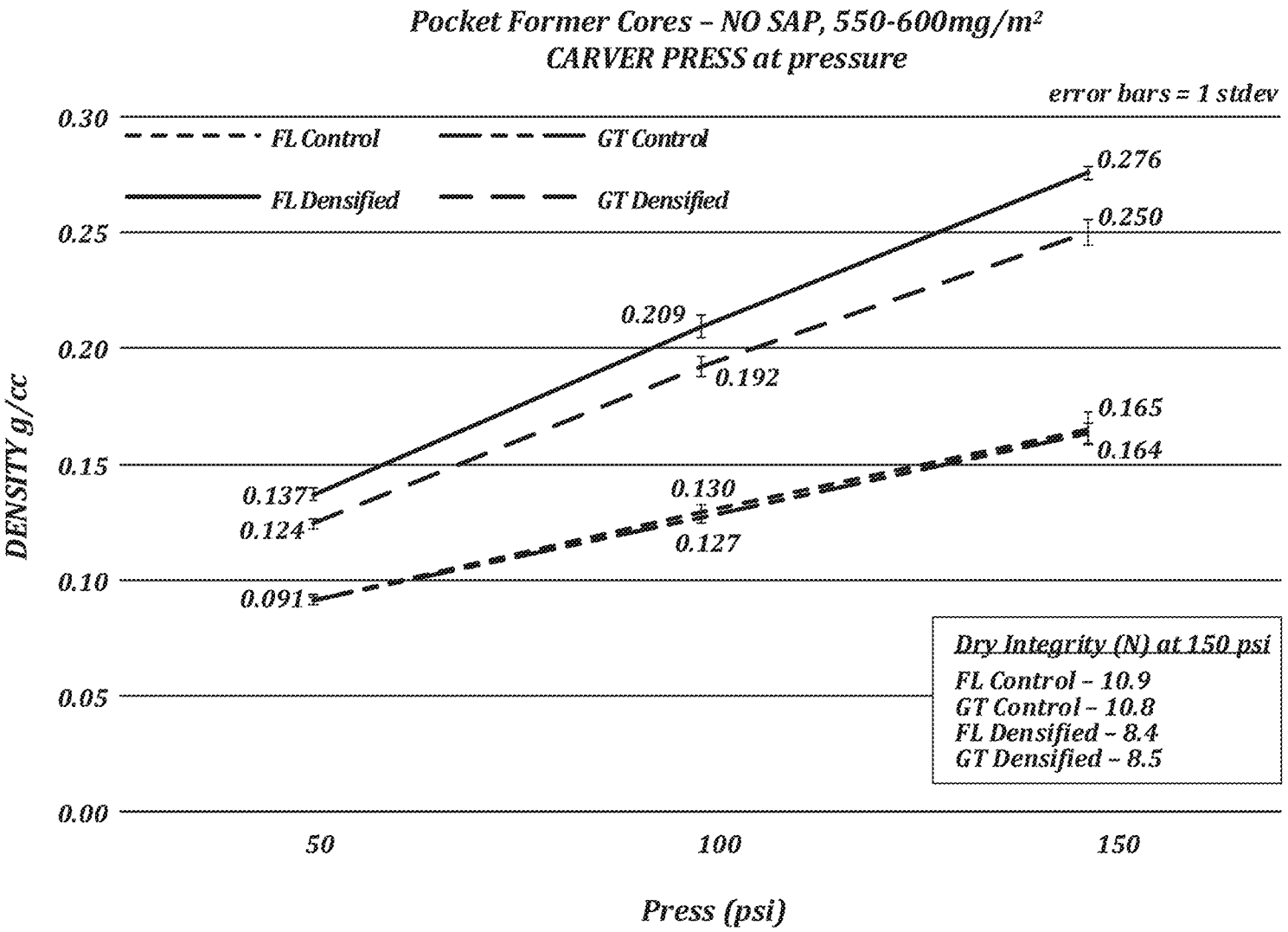
FIG. 10 is a graph plot depicting Carver Density and Pad Integrity of densifier treated and control FL 416 and GT SS pulp without SAP.
Figure 11:
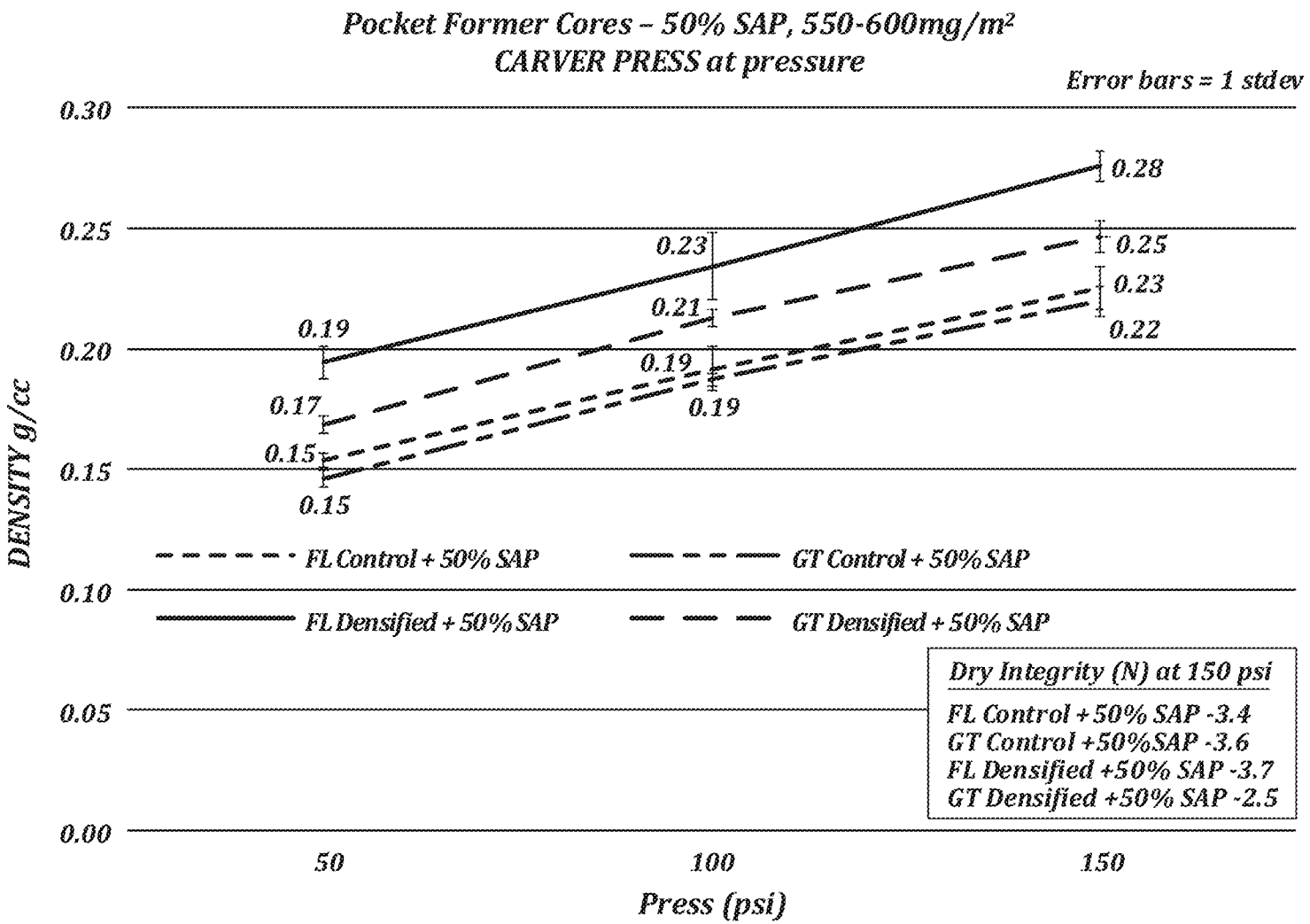
FIG. 11 is a graph plot depicting Carver Density and Pad Integrity of densifier treated and control FL 416 and GT SS pulp with 50% SAP.

FIG. 10 shows the Carver density results for the four pulps (densifier treated FL and GT pulps and respective controls) with no SAP and FIG. 11 for 50% SAP loading. Both plots also report the 150 psi pad integrity results. When densified with the Carver press both the FL and GT densifier treated pulps consistently densified substantially more than the untreated pulps across the full range of pressures evaluated, for both no SAP and 50% SAP pulps. For the 150 psi pads, the pad integrity results showed that, within the variability (noise) of the test, no substantial or consistent difference was found between FL and GT densifier treated pulps.

Figure 12:
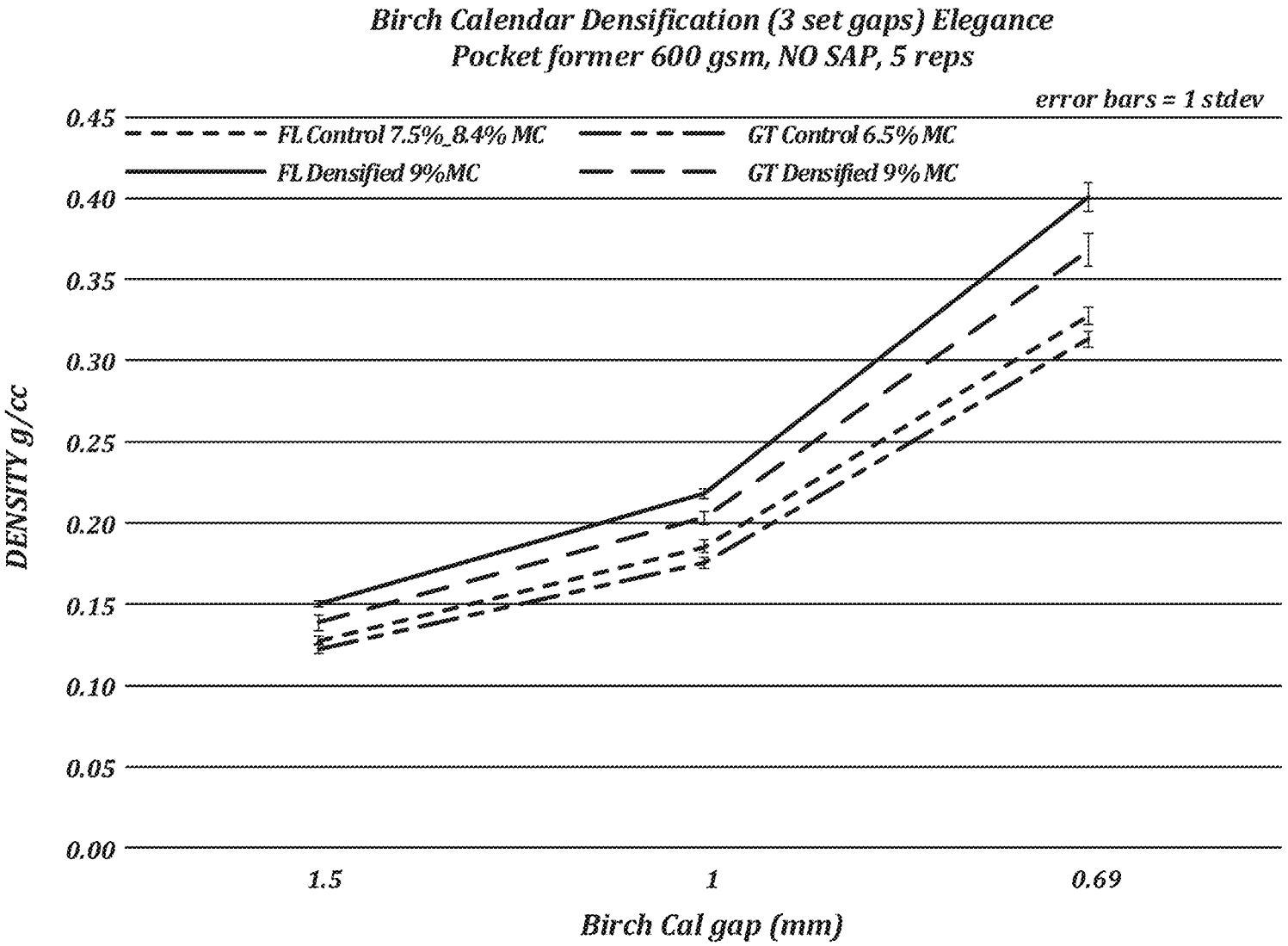
FIG. 12 is a graph plot depicting Birch Calendar Densification of densifier treated and control FL 416 and GT SS pulp without SAP.
Figure 13:
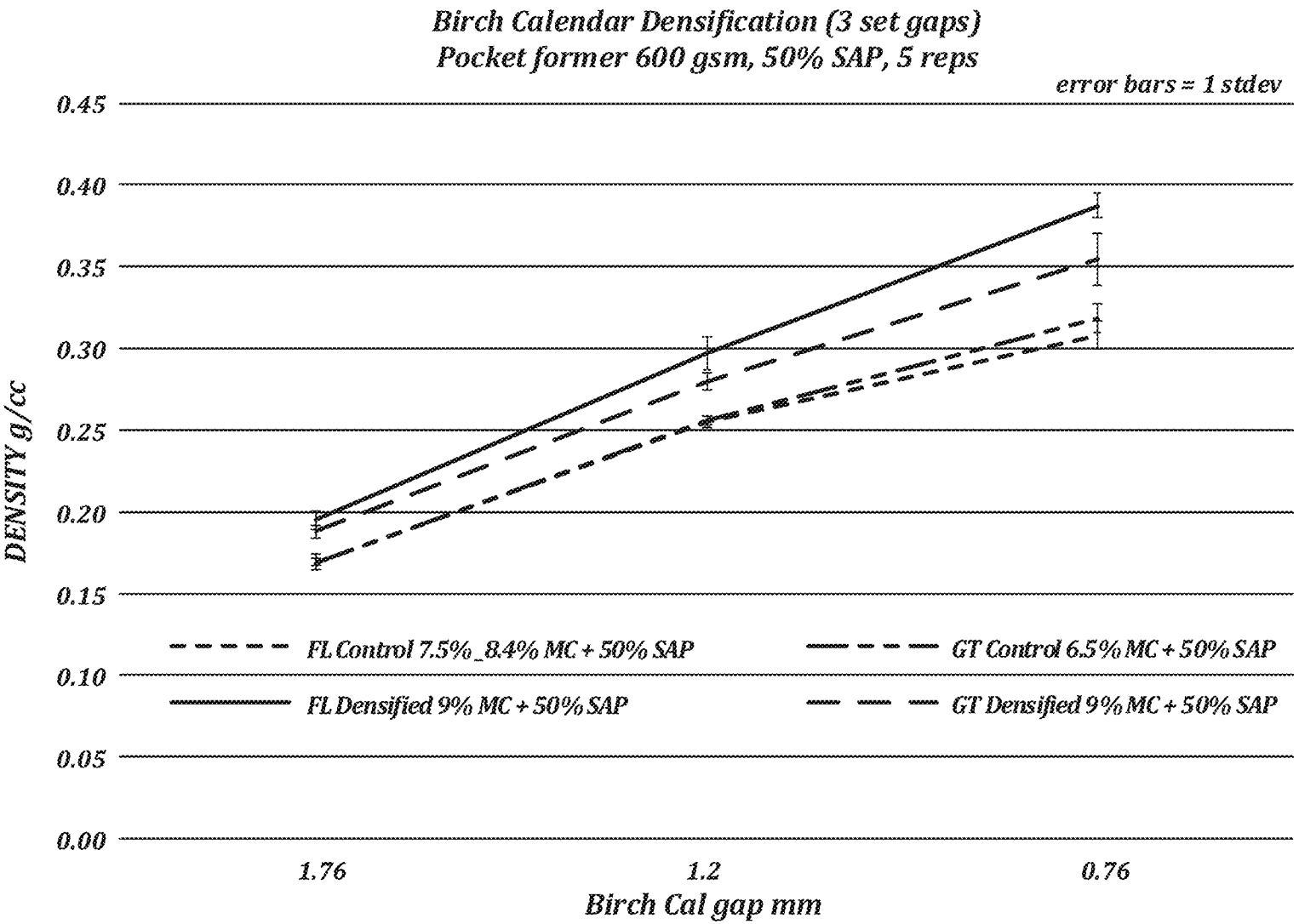
FIG. 13 is a graph plot depicting Birch Calendar Densification of densifier treated and control FL 416 and GT SS pulp with 50% SAP.

FIG. 12 shows the Birch calendar density results for the four pulps (densifier treated FL and GT pulps and respective controls) with no SAP and FIG. 13 at 50% SAP loading. Consistent with the Carver press results, Birch calendaring demonstrated that both the FL and GT densifier treated pulps consistently densified substantially more than the untreated pulps across the full range of gaps evaluated, for both no SAP and 50% SAP pulps.

Figure 14:
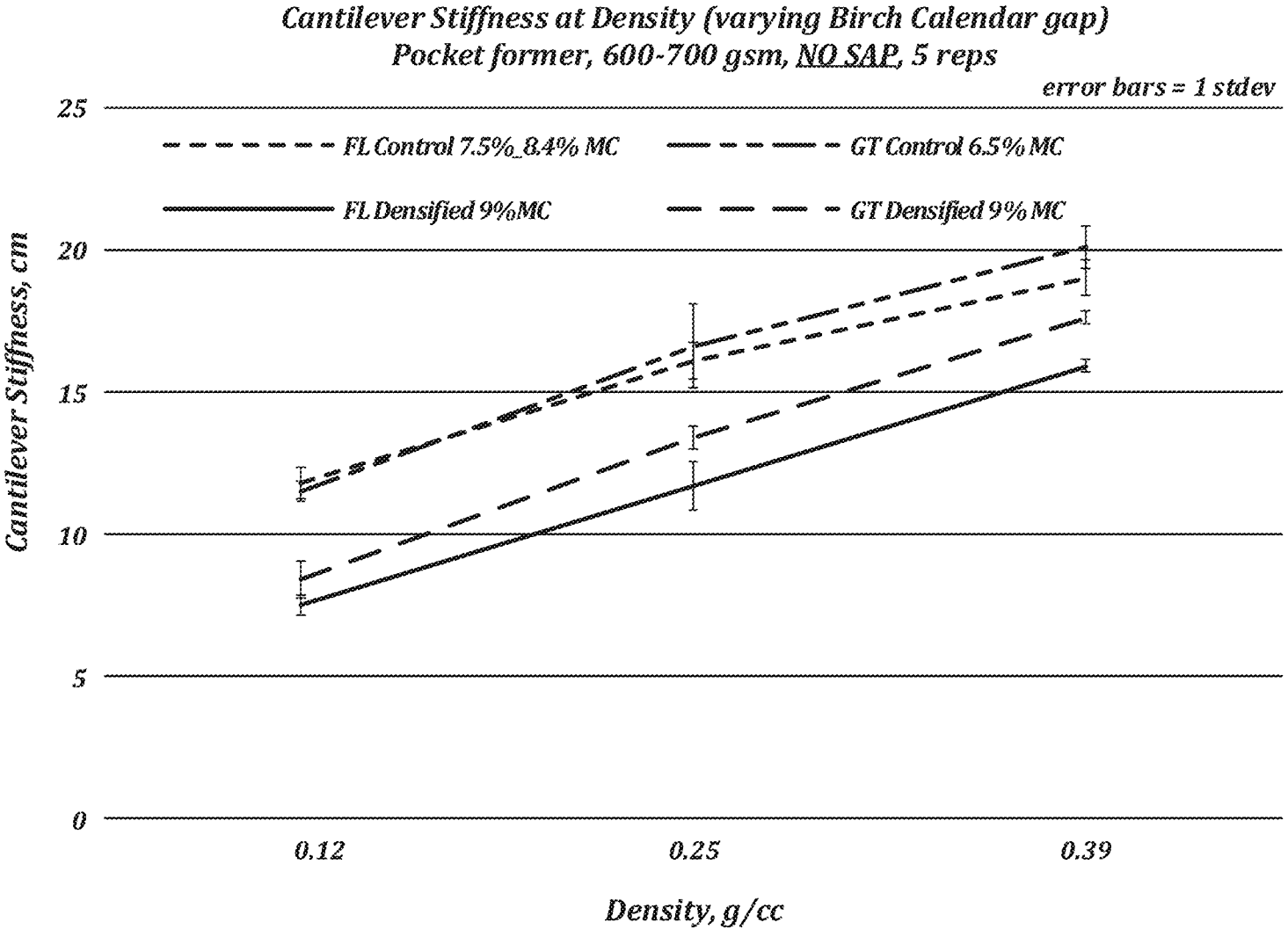
FIG. 14 is a graph plot depicting Cantilever Stiffness of densifier treated and control FL 416 and GT SS pulp without SAP.
Figure 15:
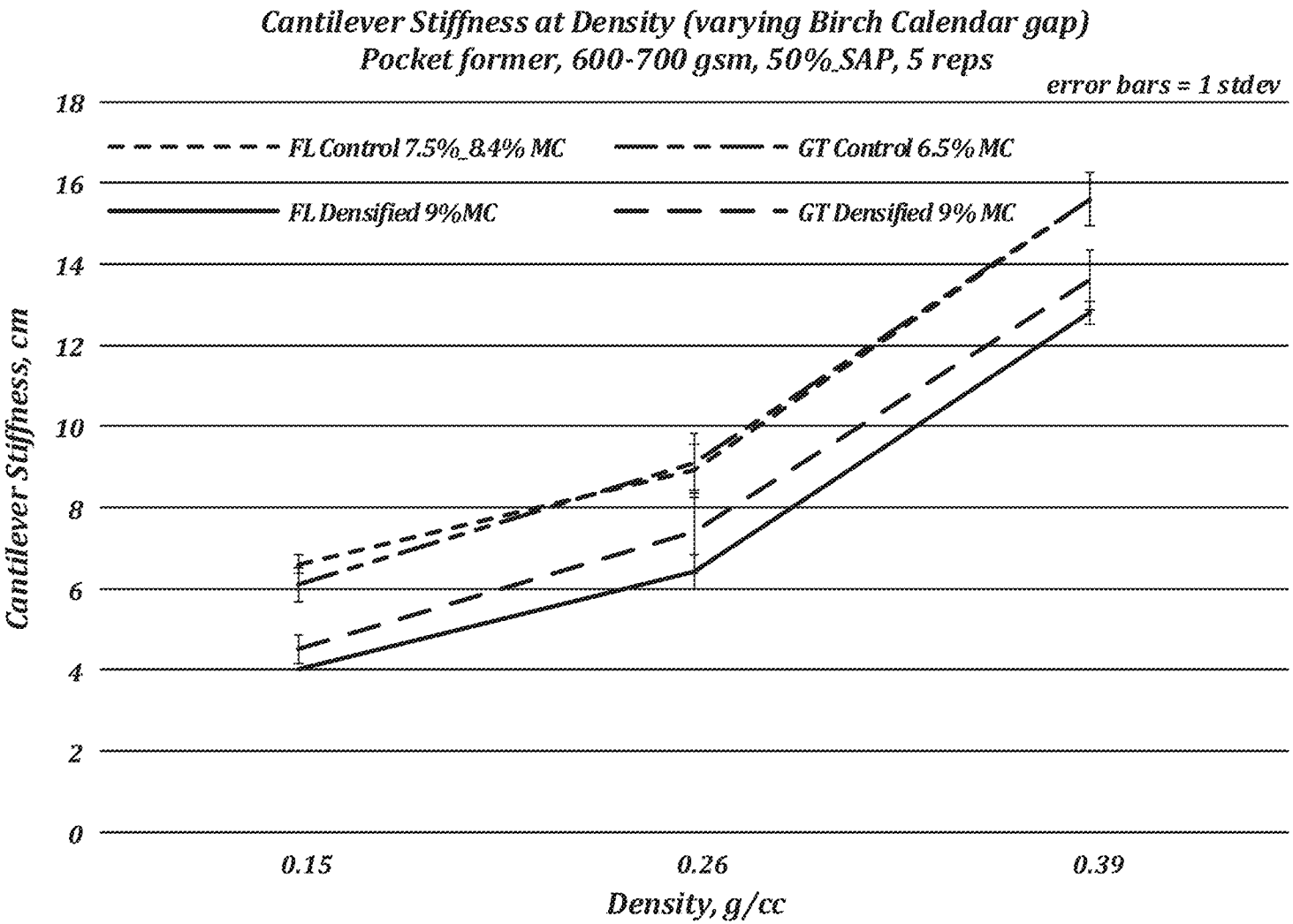
FIG. 15 is a graph plot depicting Cantilever Stiffness of densifier treated and control FL 416 and GT SS pulp with 50% SAP.

FIG. 14 displays the Cantilever stiffness results for the four pulps (densifier treated FL and GT pulps and respective controls) with no SAP and FIG. 15 at 50% SAP loading. The FL and GT base/control untreated pulps have similar softness. The densifier treatment improved and maintained the softness across the densification range regardless of the pulp source, for both no SAP and 50% SAP pulps.

Example 3

A single level of about 6.5% MC and a glycerine dosage level range of about 6% to about 8% OD was applied to standard fluff pulp during commercial pulp sheet production (Flint River ("FL" or "FR") Mill "416 Pulp" and Georgetown ("GT") Mill "SuperSoft® Pulp", International Paper Co., Memphis, Tenn.). The glycerine was applied to the dry side sheet at different dilutions and mass flow rates of a spray apparatus to maintain the desired MC and densifier agent levels. For the FL pulp trial, densifier treated FL 416 pulp produced on average 4-5% knots level in a pocket former defiberized DE test. The comparative untreated FL 416 pulp averaged 2%. Similar results were observed for the densifier treated GT SS and control pulps.

Figure 16:
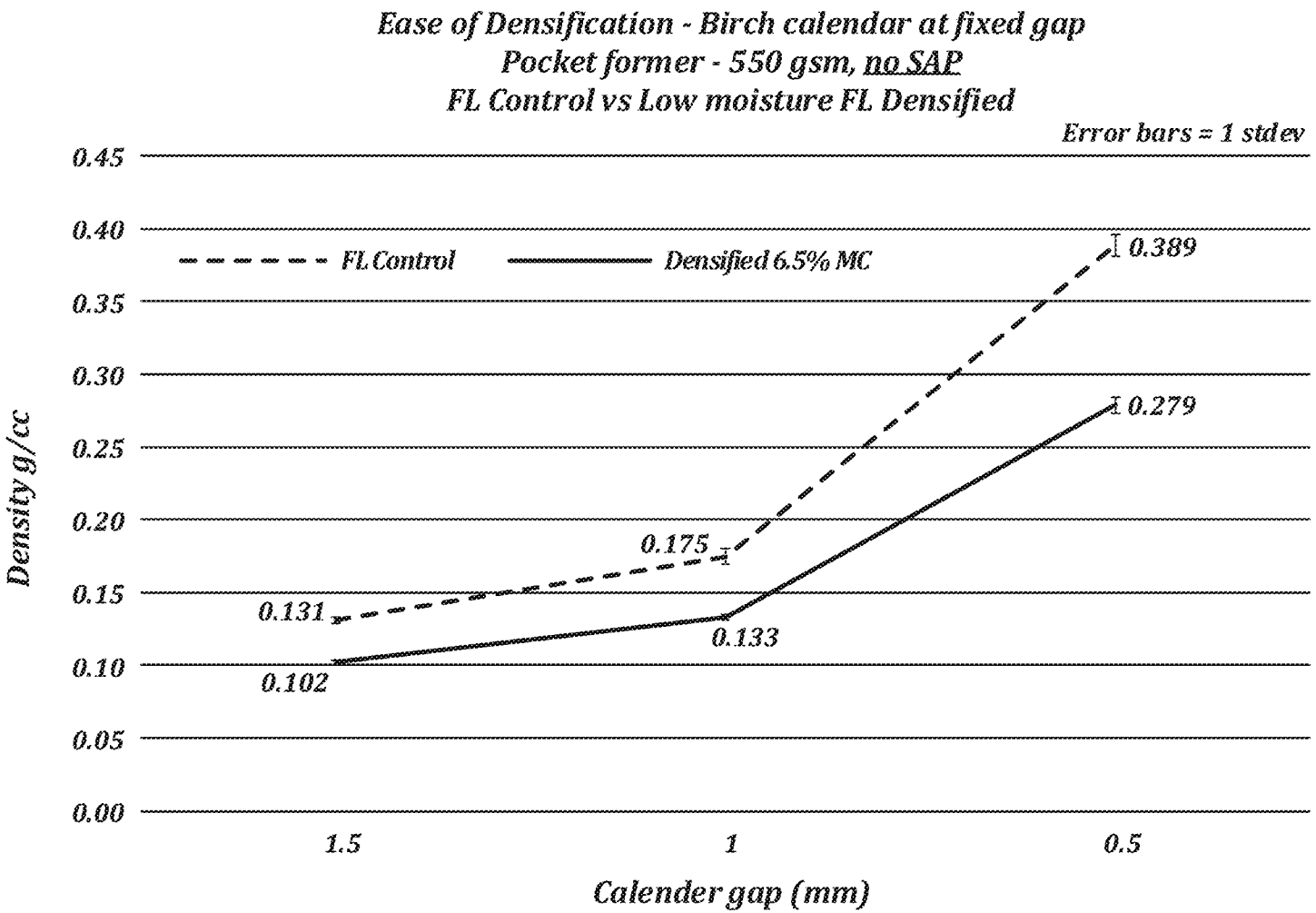
FIG. 16 is a graph plot depicting Birch Calendar Densification of commercial trial densifier treated and control FL 416 pulp without SAP.
Figure 17:
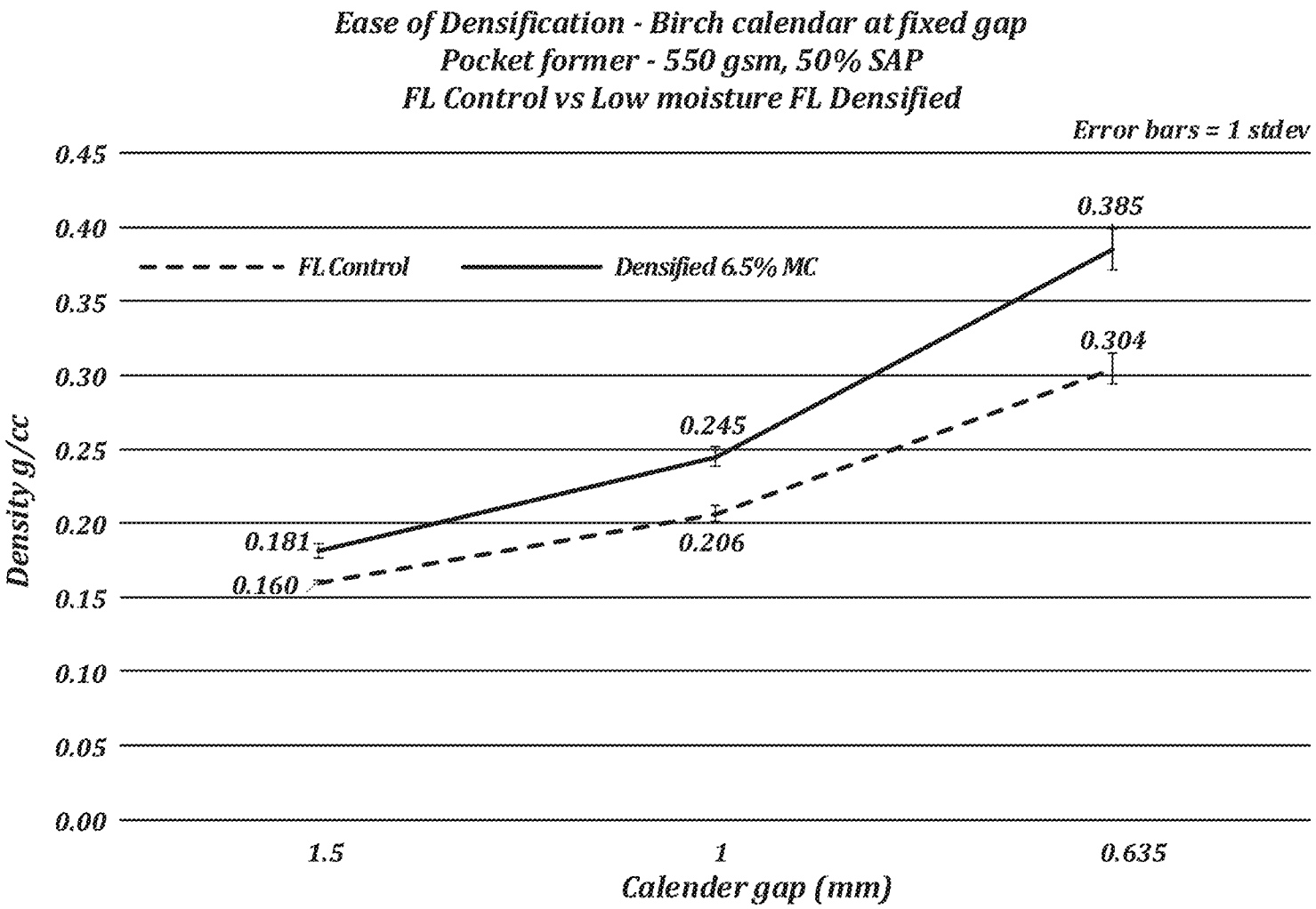
FIG. 17 is a graph plot depicting Birch Calendar Densification of commercial trial densifier treated and control FL 416 pulp with 50% SAP.

FIGS. 16 and 17 show Birch Calendar densification results for the densifier treated FL 416 pulp compared to the FL 416 control pulp, with and without SAP, respectively. Across the range of gaps evaluated the densifier treated pulp was clearly much denser, regardless of whether SAP was present or not. Similar results were observed for the densifier treated GT SS and control pulps.

As used herein, the term "about" indicates a specified value can be modified up to 10% (plus or minus) and still fall within the disclosed embodiment(s). However, with regard to weight, "about" indicates no more than an absolute 0.5 weight percent increase or decrease. For example, a range of about 1 to about 2 weight percent would include 1±0.1 to 2±0.2 weight percent, while about 5 to about 8 weight percent would include 5±0.5 to 8±0.5 weight percent.

While illustrative embodiments have been illustrated and described, it will be appreciated that various changes can be made therein without departing from the spirit and scope of the invention.

The embodiments of the invention in which an exclusive property or privilege is claimed are defined as follows:

1. A pulp sheet comprising:

hydrogen-bonded cellulose pulp fibers treated with a densifying agent, wherein the densifying agent is glycerin, wherein the densifying agent is present in the pulp sheet in an amount from 1 to 9 weight percent, wherein the pulp sheet, when fiberized at a moisture content from 0 to 9 percent in accordance with a fiberization test, produces a fiberized pulp having a knots level of less than 11.2%, wherein the fiberization test is performed using a laboratory scale Kamas Laboratory Mill, Model H01 hammermill instrumented to measure power necessary to fiberize a given weight of pulp, equipped with a screen having 19 millimeter (mm) round holes, breaker bar clearance of the hammermill is set to 4.0 mm, rotor speed is adjusted to 3024 revolutions per minute (rpm), and pulp feed rate is 2.80 grams/second at 5.0 cm wide pulp sheet, and wherein a pad of the fiberized pulp has a Carver density equal to or greater than 0.2 g/cm$^3$ at 150 psi.

2. The pulp sheet of claim 1, wherein the densifying agent is present in the pulp sheet in an amount from 5 to 9 weight percent.

3. The pulp sheet of claim 1, wherein the densifying agent is present in the pulp sheet in an amount from 7 to 9 weight percent.

4. The pulp sheet of claim 1, wherein said knots level is exhibited when the pulp sheet is fiberized at a moisture content from 5 to 9 percent in accordance with the fiberization test.

5. The pulp sheet of claim 4, wherein said knots level is exhibited when the pulp sheet is fiberized at a moisture content from 6 to 8 percent in accordance with the fiberization test.

6. The pulp sheet of claim 1, wherein the pulp sheet has a basis weight of at least 300 g/m$^2$.

7. The pulp sheet of claim 1, wherein the pad of the fiberized pulp has a Carver density from 0.2 to 0.3 g/cm$^3$ at 150 psi.

8. The pulp sheet of claim 1, wherein a pad of the fiberized pulp has a cantilever stiffness from 4.0 to 8.0 cm, as tested with a basis weight of 600-700 gsm, the pad formed without SAP, and a pad density of 0.12 g/cc.

9. A pulp product, comprising:

the pulp sheet of claim 1, wherein the pulp sheet is packaged in packaging configured to maintain the moisture content of the pulp sheet at a desired level from 0 to 9 percent.

10. The pulp product of claim 9, wherein the moisture content of the pulp sheet is from 0 to 9 percent.

11. The pulp product of claim 9, wherein the moisture content of the pulp sheet is from 5 to 9 percent.

12. A pulp sheet comprising:

hydrogen-bonded cellulose pulp fibers treated with a densifying agent, wherein the densifying agent is glycerin, wherein a pad of fiberized pulp of the pulp sheet has a Carver density equal to or greater than 0.2 g/cm$^3$ at 150 psi, wherein the pad of fiberized pulp of the pulp sheet has a property selected from the group consisting of a Carver density from 0.2 to 0.3 g/mm3 at 150 psi and a Cantilever stiffness from 4.0 to 8.0 cm, wherein the pad has a basis weight of 600-700 gsm, wherein the pad is formed without SAP, and wherein the pad has a density of 0.12 g/cc, wherein the densifying agent is present in the pulp sheet in an amount from 1 to 9 weight percent, and wherein the pulp sheet has a moisture content from 0 to 9 percent.

13. The pulp sheet of claim 12, wherein a fiberized pulp produced by fiberizing the pulp sheet according to a fiberization test has a knots level of about 3% to about 11.2%, wherein the fiberization test is performed using a laboratory scale Kamas Laboratory Mill, Model H01 hammermill instrumented to measure power necessary to fiberize a given weight of pulp, equipped with a screen having 19 millimeter (mm) round holes, breaker bar clearance of the hammermill is set to 4.0 mm, rotor speed is adjusted to 3024 revolutions per minute (rpm), and pulp feed rate is 2.80 grams/second at 5.0 cm wide pulp sheet.

* * * * *